US006939078B1

(12) United States Patent
Anderson et al.

(10) Patent No.: US 6,939,078 B1
(45) Date of Patent: Sep. 6, 2005

(54) TACTILE DETECTABLE WARNING RAMPS FOR PEDESTRIAN PATHWAYS

(75) Inventors: Jeffrey W. Anderson, Cave Creek, AZ (US); Ricky Jack Eischen, Mesa, AZ (US); Shawn L. Shelton, Goodyear, AZ (US); Delbert T. Shelton, Jr., Litchfield Park, AZ (US)

(73) Assignee: Rampdome Systems LLC, Scottsdale, AZ (US)

( * ) Notice: Subject to any disclaimer, the term of this patent is extended or adjusted under 35 U.S.C. 154(b) by 26 days.

(21) Appl. No.: 10/933,955

(22) Filed: Sep. 3, 2004

(51) Int. Cl.[7] ..... E01C 5/00
(52) U.S. Cl. ..... 404/73; 404/75; 52/742.1
(58) Field of Search ..... 404/19, 28, 29, 404/73, 75, 78; 249/2, 4, 188; 52/742.1, 52/742.12, 747.12

(56) References Cited

U.S. PATENT DOCUMENTS 1,697,765 A * 1/1929 Heltzel ..... 249/2
3,915,582 A * 10/1975 Clarke ..... 404/75
4,321,024 A * 3/1982 Terraillon ..... 425/111
5,277,573 A * 1/1994 Sullivan ..... 425/437
5,320,790 A * 6/1994 Lowe ..... 264/31
5,827,009 A * 10/1998 Kokoletsos ..... 404/75
5,887,846 A * 3/1999 Hupp ..... 249/2

* cited by examiner

*Primary Examiner*—Gary S. Hartmann
(74) *Attorney, Agent, or Firm*—Jennings Strouss & Salmon PLC; Joseph W. Mott

(57) ABSTRACT

A precast concrete slab and framing system is placed in walkways, curb ramps, platform edges, and areas of pedestrian traffic where they intersect with vehicular traffic, warning the visually handicapped of dangerous crossings. The precast slabs, which incorporate raised, truncated domes on the top side and a floated finish on the bottom side, are made to be set in the frame which has been set and cast into fresh concrete. A number of slabs are placed in a frame abutting each other on top of sand and the edges are filled with sand to lock them into place. The top surface is placed to be flush with the walking surface.

15 Claims, 6 Drawing Sheets

TACTILE DETECTABLE WARNING RAMPS FOR PEDESTRIAN PATHWAYS

BACKGROUND OF THE INVENTION

The invention relates to precast concrete slabs having raised domes to alert the visually handicapped of hazardous conditions by being placed in walkways, roadways, platform edges and areas of pedestrian traffic. The Americans with Disabilities Act Accessibility Guidelines (ADAAG), promulgated by the Access Board, an independent U.S. federal agency, established standards for tactile, detectable warnings for the visually impaired at street crossings, curb ramps, median islands and rail lines. These surfaces feature a distinctive pattern of raised truncated domes that provide a tactile cue detectable by cane or underfoot at the boundary between pedestrian and vehicular routes. The guidelines specify use of truncated domes aligned in a square grid pattern. The ADAAG call for a base diameter of 0.9 inches (23 mm) to 1.4 inches (36 mm), a top diameter of 50% to 65% of the base diameter and a height of 0.2 inches (5 mm). The center-to-center dome spacing is set at 1.6 inches (41 mm) to 2.4 inches (61 mm), with a minimum base-to-base spacing of 0.65 inches (16 mm). The surfaces are required to extend 24 inches (610 mm) in the direction of pedestrian travel and the full width of the curb ramp, landing, or blended transition.

One approach to adding the truncated dome warning is to form them on tiles designed to be glued or fastened to existing concrete. Tiles installed according to this method are not flush with the walking surface and are prone to peeling up or coming detached from the surface under certain weather conditions which cause concrete to expand and contract. Another approach, which is quite labor-intensive, is to set precast tiles into a required location which is being poured. Precast tiles set in fresh concrete must be installed when the concrete is at a proper state; the tiles will float up if concrete is too wet and will not set properly when concrete has cured faster than expected. Production time is lost due to waiting for the proper conditions for installation.

Yet another approach is a method of stamping the surface of concrete when it has reached a plasticity state. This method produces inconsistent texture and imperfections that bring the surface "out of spec". The installer has only a limited time to try to fix the surface before the concrete sets. Stamping also raises only the fines of the concrete, reducing the strength in the domes.

Known in the art is a method of placing brick pavers with domes raised on the surface. This method requires setting a block out in the concrete, increasing labor time and form materials. Also, brick pavers have numerous spaces between them.

Accordingly, what is needed is a system and method that allow the precast concrete slabs to be set in the ramp after the frame has been cast in place in the fresh concrete. Reducing the labor time while the fresh concrete is being poured and making it easy for the people in the field to set the frames and, after the ramp has cured, to set slabs, cuts down on labor cost.

BRIEF SUMMARY OF THE INVENTION

According to one aspect of the present invention a precast concrete slab with raised elements on top and a floated finish on the bottom is set into a frame that has been cast in place in the ramp and then filled in with ½" of sand and leveled off. The top surface of the slab is set flush with the walking surface and consists of raised elements known as truncated domes that meet with ADAAG draft guidelines.

These and other features, aspects, and advantages will become better understood with the drawings and descriptions.

DETAILED DESCRIPTION OF THE INVENTION

Figure 1:
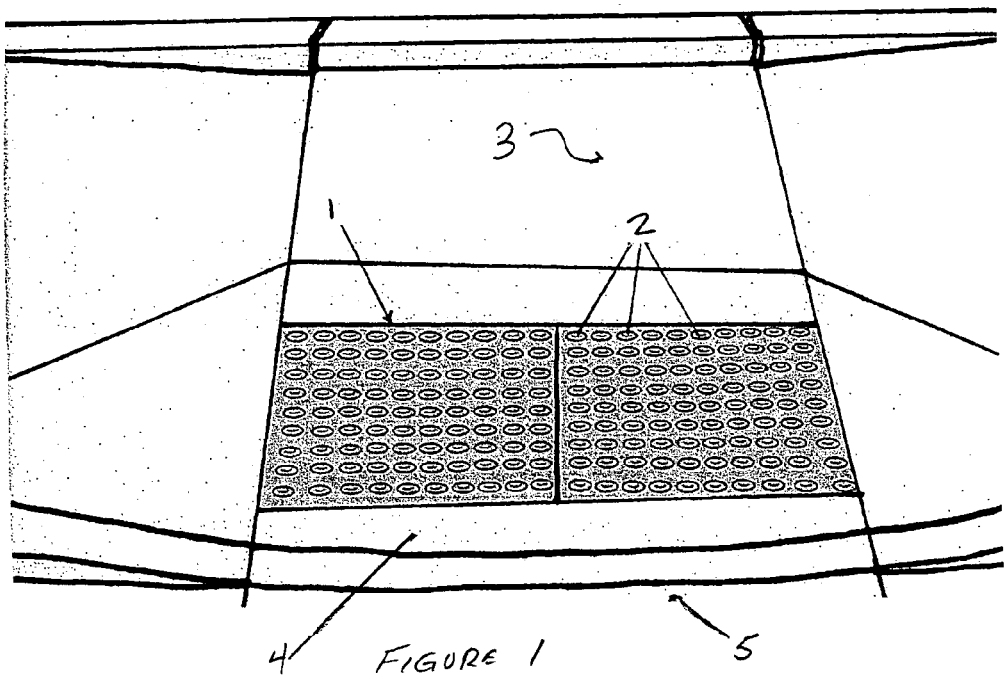
FIG. 1 shows a detectable warning ramp in place at a sidewalk curb transition.
Figure 2:
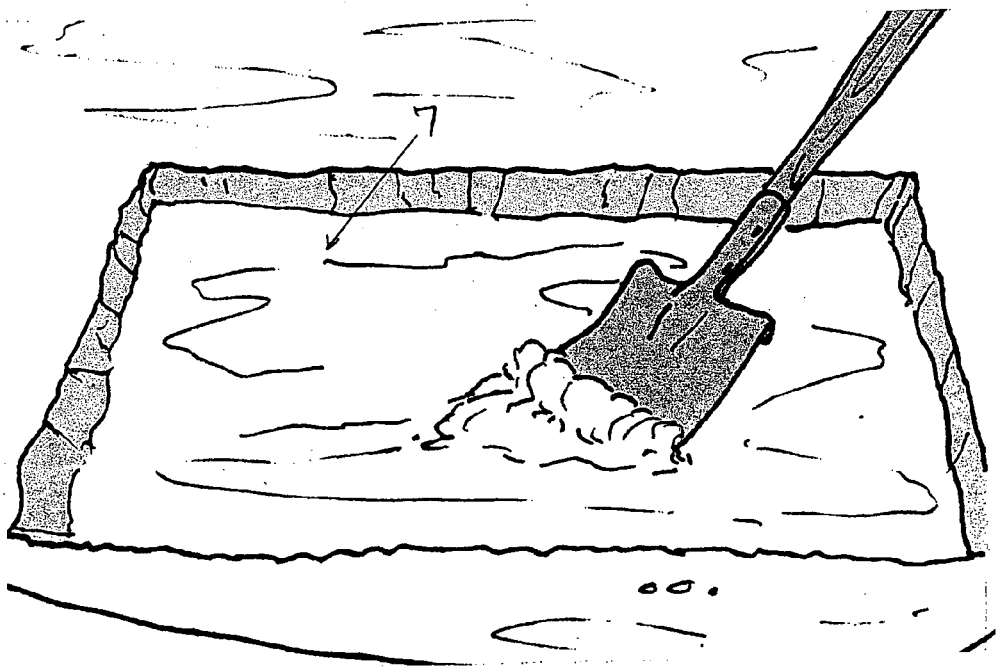
FIG. 2 shows a footing being dug to prepare for installation of a slab.
Figure 3:
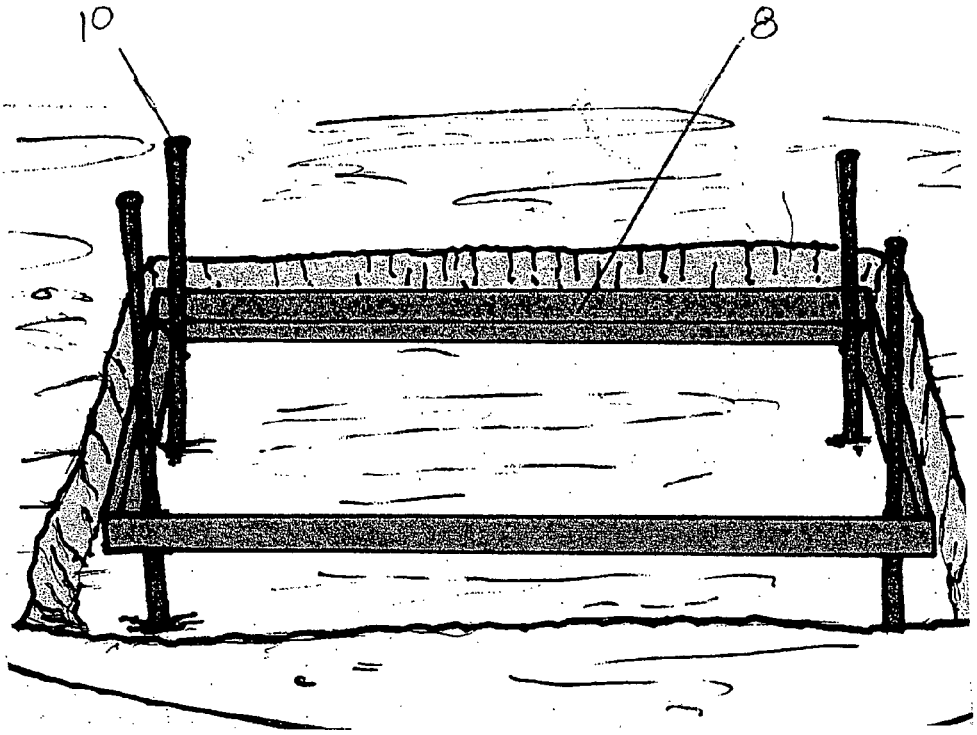
FIG. 3 shows the setting of a frame in the footing of FIG. 2.
Figure 4:
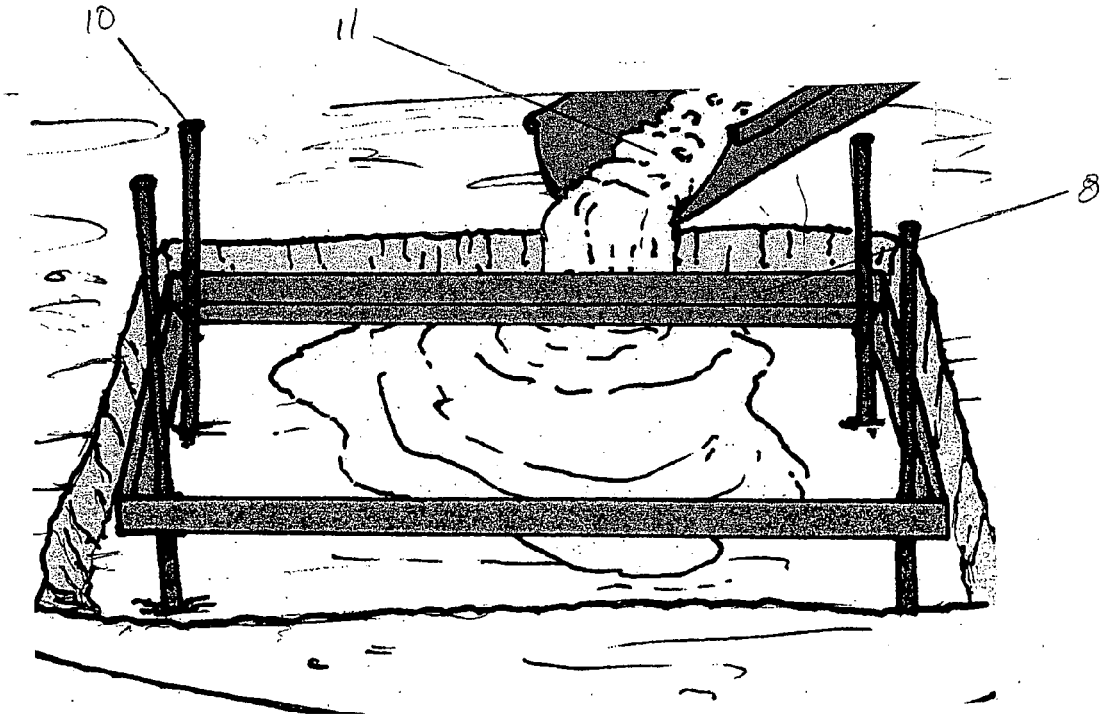
FIG. 4 shows pouring of the footing around the frame.
Figure 5:
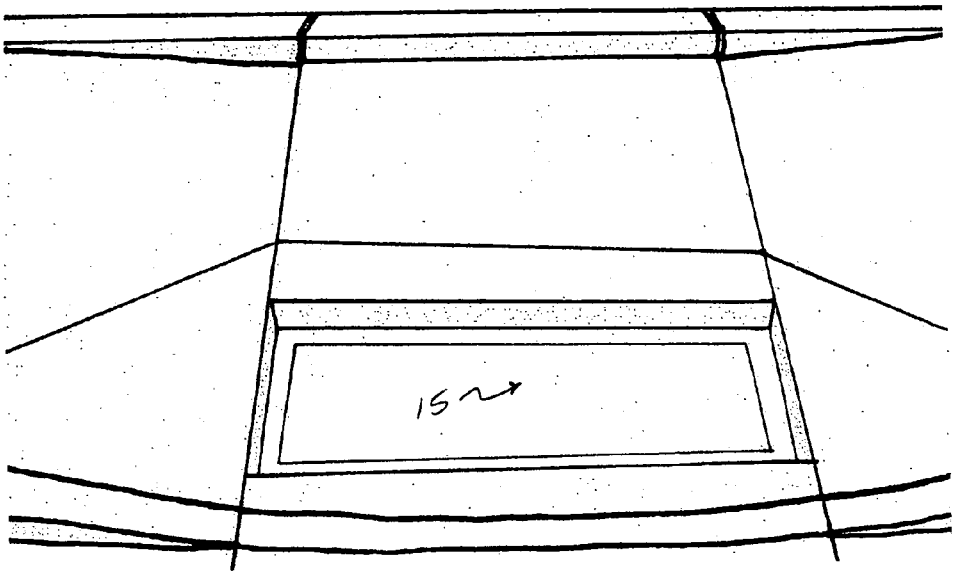
FIG. 5 shows the finished cavity awaiting slab installation.
Figure 6:
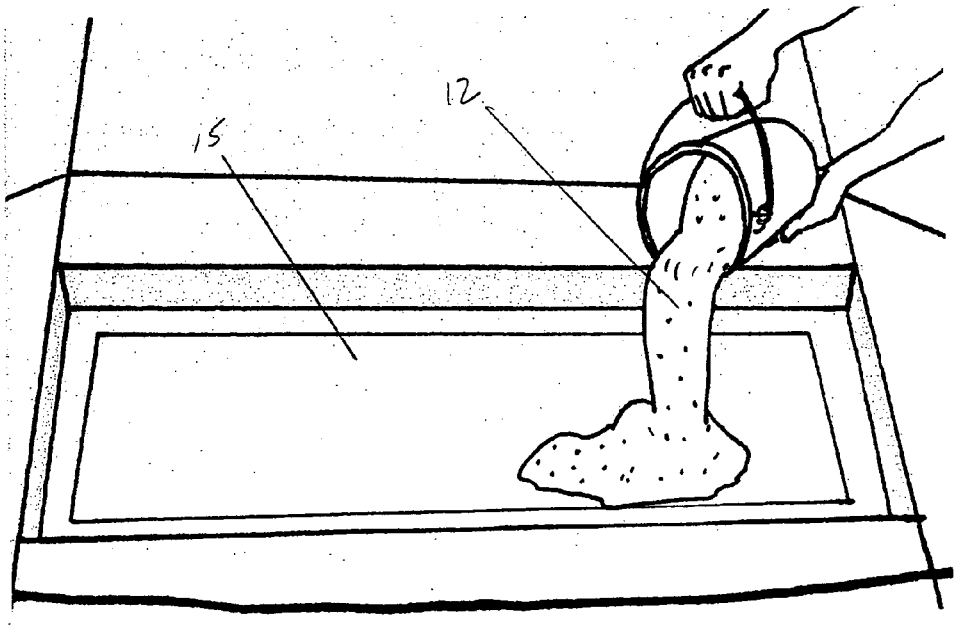
FIG. 6 shows installation of bedding material.
Figure 7:
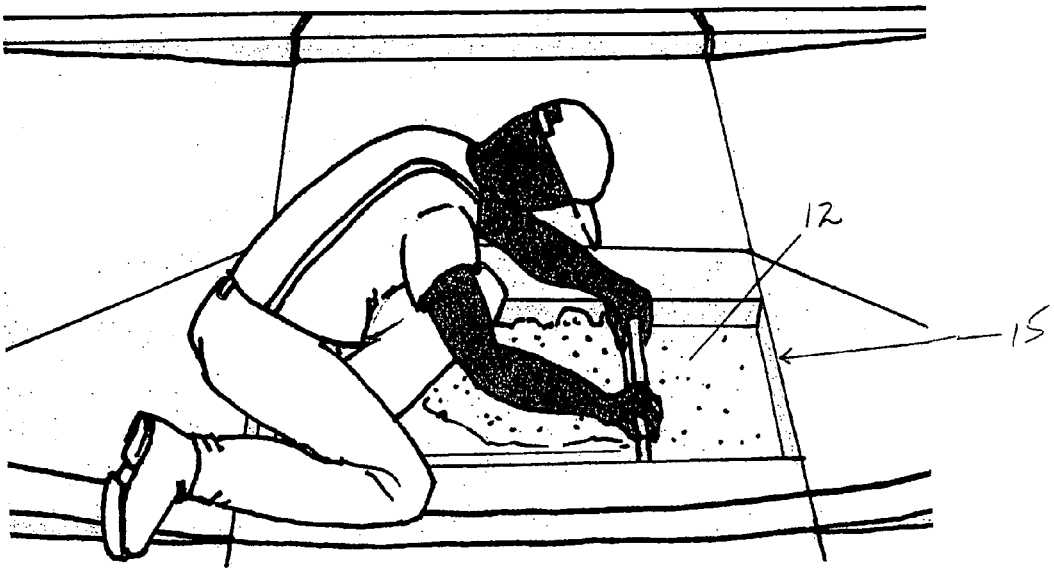
FIG. 7 shows leveling of bedding material.
Figure 8:
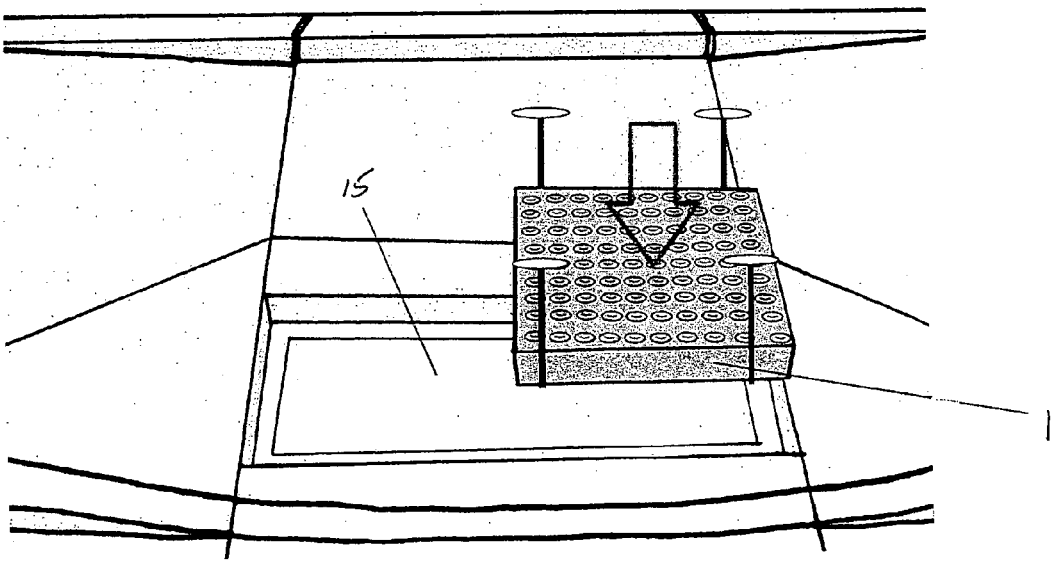
FIG. 8 shows insertion of the precast slab.
Figure 9:
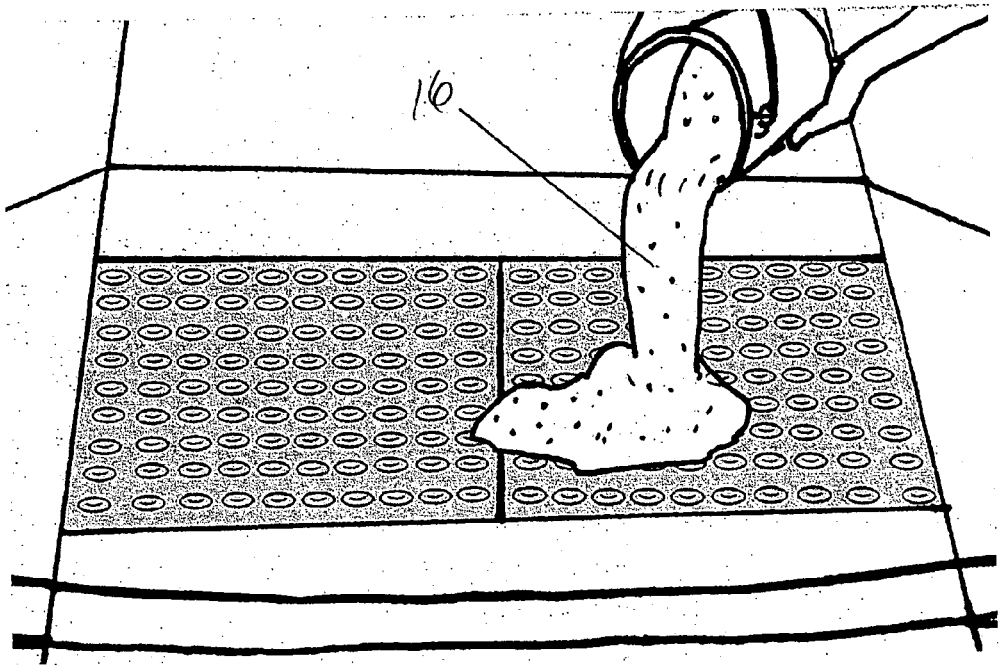
FIG. 9 shows adding bedding material to lock the slabs.
Figure 10:
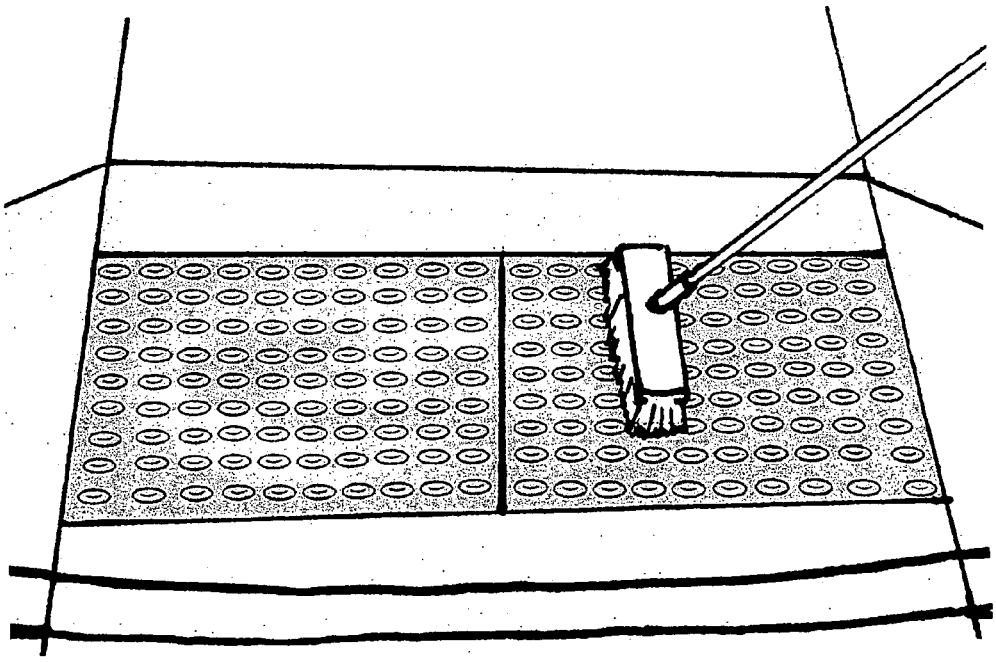
FIG. 10 shows cleanup of the excess materials.

FIG. 1 illustrates a detectable warning ramp in place at a sidewalk curb transition, located between the sidewalk (3) and the sloped curb (4) leading to the street (5). Slabs (1) incorporate truncated domes (2) having dimensions and spacing according to the ADAAG specifications. The slabs are precast lightweight concrete, installed in accordance with the method of the present invention.

Precast domed concrete slabs may be manufactured using known techniques. In a preferred method, lightweight concrete is poured into a receiving form having truncated domes inverted on the bottom. A releasing agent is sprayed into the form before the concrete is poured so the concrete will separate from the form once it has hardened. The top of the poured concrete, which will become the bottom of the slab when it is removed from the form and inverted, is floated so the slab bottom will be even. The concrete is cured in the form using conventional means, and the form is then removed, leaving a slab with truncated domes. Further curing may be desirable to achieve an optimal strength in the 3500 PSI range. In a preferred embodiment, the form is configured so that the resulting slab has a chamfered edge along the top of all four sides.

In accordance with the ADAAG standard the slab dimensions are 24" in the direction of travel by a variable length equal to the width of the ramp containing the transition. For convenience, slabs of uniform dimension, about two feet by two feet, may be installed side by side at the transition ramp. A slab thickness of about 3.25" is needed to provide sufficient strength when using common lightweight concretes. The ADAAG also require color contrast between the warning ramp and the surrounding pavement; this may be achieved by adding a pigment to the concrete poured into the receiving form or by painting the slab after it is cured.

The field location where the transition ramp is to be installed is prepared in accordance with the method of the present invention. Detectable warning ramps may be installed either in new construction or as a retrofit to existing structures. The description below involves new locations, but is readily adaptable to modifying existing locations.

FIGS. 2–10 show the sequence of operations in a preferred embodiment of the inventive method. First a footing (7) is dug at the location where the ramp will be installed. This may conveniently be done simultaneously with the footing excavation for the sidewalk, curb and gutter at that location. In some locations, the footing must be prepared by removing pre-existing concrete, pavement or other installed materials. It may or may not require excavation of soil, but it is generally referred to herein as an excavated area. The excavated area should preferably be about 6" larger than the warning ramp to be installed and to a depth of about 6" below the bottom of the frame.

Figure 11:
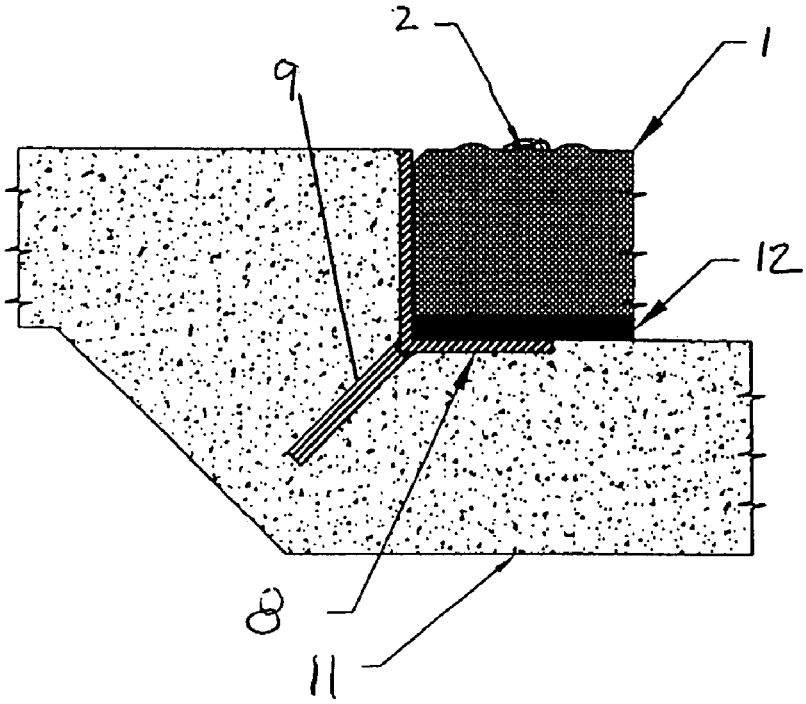
FIG. 11 is a section view of a portion of a slab in place.

A rectangular steel frame (8) is fabricated of 4"×3"×¼" angle iron or other suitable material. In meeting the ADAAG requirements, the frame is rectangular with width (referring to the dimension in the direction of pedestrian travel) of 24½" inside to inside, and length determined by the walking surface or ramp where the detectable warning ramp will be placed. In a preferred embodiment, short lengths of standard reinforcing bar (9), preferably ¼" diameter and about 3" long, may be welded at a 45° angle off the bottom of the frame, as illustrated in FIG. 11. These bars will adhere to the cast-in-place concrete and enhance stability of the frame. For esthetics, the frames may be painted with a coat of shop gray paint.

The frame is then set in the footing excavation using forming pins (10) common to everyday concrete work. Forming pins (10) are driven into the ground under the footings and fixed in each corner of the frame by a nail, tying wire, or other conventional technique. The top surface of the frame is set at the elevation and slope of the desired finished ramp surface.

Cast-in-place concrete (11) is then poured into the footing and made to run under and around the frame (8), forming a cavity (15) in the walkway or ramp. Inside the frame, the concrete is floated to the bottom of the frame, ensuring that no concrete extends or protrudes above the frame bottom. The concrete is then cured by normal techniques.

Once the concrete is cured enough to sustain foot traffic, the inside of the frame is cleaned and smoothed. A bedding layer (12), preferably one half inch of silicon sand or other fine sand, or other bedding layer material known in the art, is placed in the bottom of the enclosure and leveled to a surface about 3¼" below the top of the frame. Any excess bedding is removed so the depth from the top of the bedding to the finished ramp surface is the same as the depth of the slab to be placed in the cavity.

The precast slabs (1) containing the truncated domes are then set into the frame by hand or using conventional tools. The slabs are placed directly on the bedding so that the surface containing truncated domes is flush with the ramp.

Additional bedding material (16), or other suitable stabilizing material, preferably fine sand, is swept over the top surface of the slabs and into the joints around the slabs or otherwise inserted into the joints around the slabs, to lock the slabs in place. Excess material is swept away.

If a slab ever needs replacement (for example, when an overload has cracked it), it can be lifted directly out of the enclosure.

The present invention has been described with reference to a particular embodiment thereof. Persons of ordinary skill in the art will readily understand that the inventive concept may be applied to a variety of configurations. For example, the method may be applied to retrofit an existing walkway or curb transition with a detectable warning ramp where digging the footing includes first jackhammering or breaking and removing existing concrete in the area where the ramp is to be placed. Larger, smaller, or thicker dome-containing slabs may be desirable in some locations, and single pieces rather than side-by-side slabs might be used. The rectangular sections described above are needed for ADAAG compliance, but precast slabs of other shapes, with corresponding frames, might be used.

What is claimed is:

1. A method of installing detectable warning ramp segments at platforms, transitions or ramps, comprising placing a frame in an excavated area at a proper slope and elevation to align with a desired surface at a target location; pouring cast-in-place concrete into the excavated area to surround the frame and form a cavity bounded by the frame; and placing at least one precast concrete slab incorporating detectable warning features into the cavity after the cast-in-place concrete sets.

2. The method of claim 1 wherein the frame is a rectangular structure of angle iron.

3. The method of claim 2 wherein the frame is held in place prior to pouring concrete by setting steel pins in the ground below the excavated area and attaching the frame to the steel pins.

4. The method of claim 3 wherein the frame includes at least one reinforcing bar protruding at an angle from a bottom portion of the frame.

5. The method of claim 3 further including the step of placing a bedding layer in the cavity after the cast-in-place concrete sets and placing the precast concrete slab on the bedding layer.

6. The method of claim 5 further including the step of applying a stabilizing material so that some falls around the slab and between the slab and the frame, thereby stabilizing the slab in place.

7. The method of claim 1 wherein the detectable warning feature comprises a pattern of raised truncated domes.

8. The method of claim 6 wherein the detectable warning feature comprises a pattern of raised truncated domes.

9. The method of claim 5 wherein the bedding layer is sand.

10. The method of claim 6 wherein the stabilizing material is sand.

11. A method of installing detectable warning ramp segments at platforms, transitions or ramps, comprising excavating an area under and around a target location; placing a rectangular angle iron frame in the excavated area at a proper slope and elevation to align with a desired surface at the target location; pouring cast-in-place concrete into the excavated area to surround the frame and form a cavity bounded by the frame; placing a layer of a bedding material in the cavity after the cast-in-place concrete sets; placing at least one precast concrete slab incorporating truncated dome detectable warning features on the bedding material; and adding stabilizing material around the slab.

12. The method of claim 11 wherein the stabilizing material is sand and the bedding material is sand.

13. A tactile detectable warning ramp segment for pedestrian walkways comprising an angle iron frame set into concrete and at least one precast concrete slab incorporating truncated dome features resting on the frame.

14. The ramp segment of claim 13 further comprising a bedding material below the slab and stabilizing material around the slab.

15. The ramp segment of claim 14 further comprising a stabilizing material between the slab and the frame.

* * * * *